US008216091B2

(12) United States Patent
Neal et al.

(10) Patent No.: US 8,216,091 B2
(45) **Date of Patent: *Jul. 10, 2012**

(54) SLIDING IMPULSE DEVICE

(75) Inventors: Phillip H. Neal, San Rafael, CA (US); Royce Nelson, Oakland, CA (US)

(73) Assignee: Diggin Active, Inc., Emeryville, CA (US)

( * ) Notice: Subject to any disclaimer, the term of this patent is extended or adjusted under 35 U.S.C. 154(b) by 7 days.

This patent is subject to a terminal disclaimer.

(21) Appl. No.: 12/791,775

(22) Filed: Jun. 1, 2010

(65) Prior Publication Data

US 2010/0240278 A1 Sep. 23, 2010

(51) Int. Cl.
*A63B 69/00* (2006.01)
*A63B 43/04* (2006.01)
*A63B 67/06* (2006.01)

(52) U.S. Cl. ..... 473/422; 473/446; 473/595; 473/588

(58) Field of Classification Search ..... 473/422, 473/446, 595, 522, 415, 451, 599, 603–607, 473/612, 165, 351, 589; 273/118 D, 108.1, 273/108.5, 342

See application file for complete search history.

(56) References Cited

U.S. PATENT DOCUMENTS

| | | | | |
|---|---|---|---|---|
| 336,179 | A | 2/1886 | Vogelsang | |
| 2,031,240 | A | 2/1936 | Deest | |
| 2,211,330 | A | 8/1940 | Hochberg | |
| 2,362,064 | A | 11/1944 | Giesinger | |
| 2,606,030 | A | 8/1952 | Tjomsland | |
| 2,640,699 | A | 6/1953 | Garbo | |
| 2,812,184 | A | 11/1957 | McGee | |
| 3,099,450 | A | 7/1963 | Randall | |
| 3,416,800 | A | 12/1968 | Randall | |
| 3,887,183 | A | 6/1975 | Saso | |
| 3,930,650 | A | 1/1976 | Watson | |
| 4,257,599 | A | 3/1981 | Cutri | |
| 4,378,653 | A | 4/1983 | O'Brien | |
| 4,616,827 | A | 10/1986 | Bergland | |
| 5,131,665 | A | 7/1992 | Myers | |
| 5,224,959 | A | 7/1993 | Kasper | |
| 5,251,908 | A | 10/1993 | Myers | |
| 5,280,906 | A | 1/1994 | Vitale | |
| D350,629 | S | 9/1994 | Scrani | |
| 5,388,825 | A * | 2/1995 | Myers et al. | 473/570 |
| 5,431,397 | A | 7/1995 | Eckel et al. | |
| 5,472,187 | A | 12/1995 | Kempf | |
| 5,476,267 | A | 12/1995 | Gertsikov | |
| 5,480,143 | A | 1/1996 | McMurry | |
| 5,566,948 | A | 10/1996 | Kidd | |

(Continued)

*Primary Examiner* — Mitra Aryanpour

(74) *Attorney, Agent, or Firm* — Patent Law Offices of Michael E. Woods; Michael E. Woods

(57) ABSTRACT

A structure motivated by an impulse to slide over a surface, including: an impulse-receiving portion for receiving the impulse, the impulse-receiving portion defining a section of a generally semi-hemispherical structure and produced from a foam material patterned to represent at least a portion of a sports ball; and a sliding portion, coupled to the impulse-receiving portion, for sliding contact with the surface on a contact surface of the sliding portion responsive to the impulse the contact surface having a generally planar smooth surface having a periphery surrounded by an extension of the impulse receiving portion, wherein a tumbling of a coupled combination of the impulse-receiving portion and the sliding portion is inhibited by shifting a center of gravity downward by a greater weighting of the sliding portion relative to the impulse-receiving portion.

19 Claims, 11 Drawing Sheets

U.S. PATENT DOCUMENTS

| | | | | |
|---|---|---|---|---|
| 5,827,109 | A | 10/1998 | Krull | |
| 6,142,894 | A * | 11/2000 | Lee | 473/570 |
| 6,264,574 | B1 | 7/2001 | Nelson et al. | |
| 6,299,553 | B1 * | 10/2001 | Petuchowski et al. | 473/409 |
| 6,431,942 | B1 | 8/2002 | Krull | |
| 6,712,487 | B2 * | 3/2004 | Liou | 362/253 |
| 6,905,430 | B2 | 6/2005 | Davis | |
| 7,247,105 | B2 * | 7/2007 | Huntsberger | 473/433 |
| 7,549,930 | B2 | 6/2009 | Rice | |
| D602,542 | S | 10/2009 | Oblack et al. | |
| 7,727,088 | B2 | 6/2010 | Neal et al. | |

* cited by examiner

SLIDING IMPULSE DEVICE

CROSS REFERENCE TO RELATED APPLICATIONS

This Application claims the benefit of U.S. Provisional Application 60/772,488 filed on 27 Feb. 2006 and U.S. Application Ser. No. 11/610,466 filed on 13 Dec. 2006, now U.S. Pat. No. 7,727,088, the entireties of their disclosures are expressly incorporated herein for all purposes.

BACKGROUND OF THE INVENTION

The present invention relates generally to impulse-receiving devices for sliding over a surface responsive to an impulse, and more particularly to impulse-receiving devices fashioned to be evocative of sports equipment suitable for management by young children that impart such impulses through kicking or striking with hand-held implements.

Participation in various sporting activities by children has many advantages in beginning to teach various fundamentals of teamwork, technique, and body coordination skills useful in many contexts. Unfortunately for very young children (about four to six years of age), the equipment used for some of these sporting activities is not suitable, either because the equipment is too large, requires a certain amount of skill that exceeds the abilities of the children just to begin participation, or are otherwise unwieldy so that participation is difficult if even possible, delaying development of some of the desired fundamentals and limiting enjoyment of participation in these sporting activities.

Two classes of sporting activities are particularly difficult, one class includes sporting activities in which a ball is kicked, another is a class in which a ball or puck is struck by a stick or other implement. Balls are very difficult for a very young child to manage in this context as the balls are usually large relative to the child, the bill will roll or move away from the child relatively easily, the conventional ball often has a relatively large mass that can cause injury to another child or property when mismanaged, particularly with energetic but undisciplined kicking or striking. Especially because very young children often play indoors, risk to property from use of conventional sports equipment may be higher than desired.

These factors make participation in sporting activities that use conventional balls difficult if even possible, and hence any positive development skills are delayed. The very young child may develop motor skills, coordination, and derive enjoyment from participation if the equipment were appropriately adapted to accommodate their physical abilities and training while also reducing opportunities for injury to themselves, others, and property.

What is needed is an impulse-receiving device suitable for use by very young children participating in modified sporting activities that reduces at least some of the drawbacks of conventional ball systems while preserving and/or enhancing many of the advantages of participation in these sporting activities.

BRIEF SUMMARY OF THE INVENTION

Disclosed is an apparatus and method for an impulse-driven sliding device primarily for use by young children to simulate desired attributes of ball or puck games while adapting specified attributes to promote safe, effective use for those having reduced training and/or motor-skills. The apparatus includes a structure motivated by an impulse to slide over a surface, including: an impulse-receiving portion for receiving the impulse, the impulse-receiving portion defining a section of a generally semi-hemispherical structure and produced from a foam material patterned to represent at least a portion of a sports ball; and a sliding portion, coupled to the impulse-receiving portion, for sliding contact with the surface on a contact surface of the sliding portion responsive to the impulse the contact surface having a generally planar smooth surface having a periphery surrounded by an extension of the impulse receiving portion, wherein a tumbling of a coupled combination of the impulse-receiving portion and the sliding portion is inhibited by shifting a center of gravity downward by a greater weighting of the sliding portion relative to the impulse-receiving portion. The method includes a) receiving an impulse at a top portion of a device including the top portion coupled to a bottom sliding plate and converting the impulse to a non-tumbling, non-rolling, non-launching translating force; and b) sliding, responsive to the non-tumbling, non-rolling, non-launching translating force, the device over a generally planar surface.

Embodiments of the present invention include a sliding ball for use in soccer or hockey—or other similar game. It's primary, but not exclusive, benefit is to be played safely indoors—a) it is soft b) it is designed to move low to the ground so as not to break anything 3) it is designed not to roll away so the player can easily keep control of it. Disclosed is an impulse-receiving device suitable for use by very young children participating in modified sporting activities that reduces at least some of the drawbacks of conventional ball systems while preserving and/or enhancing many of the advantages of participation in these sporting activities.

DETAILED DESCRIPTION OF THE INVENTION

The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

Figure 1:
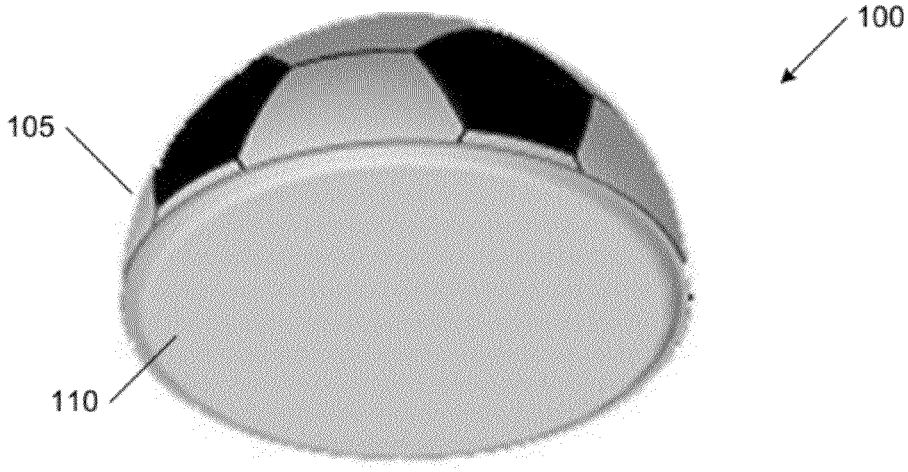
FIG. 1 is a perspective view of a first embodiment of an impulse-receiving device embodying the present invention.

FIG. 1 is a perspective view of a first embodiment of an impulse-receiving device 100 embodying the present invention. Device 100 includes two portions: an impulse-receiving top portion 105 and a sliding bottom portion 110. Device 100 includes a number of features, materials, and characteristics that promote minimization of tumbling when receiving an impulse. As shown in FIG. 1, top portion 105 simulates a section of a soccer ball—being patterned and textured to be suggestive of such a ball.

Top portion 105 is preferably constructed of lightweight/low-density foam material that may be patterned/textured/colored and the like. Alternatively, other constructions may include an inflated air bladder or a skeletal/wire frame construction. In the embodiments evocative of a "ball"—such as for a soccer ball or a playground ball, top portion is produced as a hemisphere or a section of hemisphere given other considerations as explained herein. In some implementations, top portion 105 may be a full spherical component.

Bottom portion 110 is a substantially planar polymer/polycarbonate/plastic component having a balanced coefficient of friction factoring in a desire to easily slide over a variety of surfaces while not being so "slippery" that the intended user group has difficulty in managing device 100 with it moving too easily out of reach. Different implementations balance these factors over a range appropriate for the intended surface or surfaces and age/skill level of the intended user group. Bottom portion 110 includes a surface contacting portion that is typically polished to achieve the desired coefficient of friction while other embodiments include raised bumps, rings or a series of small, flat polymer components with a low coefficient of friction, to achieve the desired slide effect. Bottom portion preferably has a diameter in a range of about two inches to about fifteen inches and more preferably in a range of about four inches to about eight inches, and most preferably about six inches. Some embodiments may not be circular and could include some other profile.

The desired surface are typical of play surfaces and include a multitude of flat, slick surfaces (carpet, linoleum, wood, grass, concrete, blacktop, and the like) when motivated by kicking the ball component.

In use, device 100 rests over a surface by contacting bottom portion 110 to the surface and exposing top portion 105 for receipt of an impulse. In the preferred embodiment, a user applies the impulse, such as by kicking or striking top portion 105 with an implement and device 100 slides over the surface in response to the impulse without tumbling or leaving the ground. When device 100 comes to rest, it remains at rest absent receipt of another impulse. Device 100 dampens responses to low-force impulses, thus making device slide but a little distance if at all in response to a similar impulse that, when applied to a conventional ball on the similar surface, would cause the conventional ball to travel a much larger distance. A key element is that the little distance and larger distance are related to within "reach" of the user in that the little movements of device 100 maintain device 100 within reach of the user while the larger distance places the conventional device outside this reach. An impulse of sufficient magnitude evidencing a definite desire to move device 100 is required to cause device 100 to slide such a larger distance. An ability for younger children to easily maintain device 100 within reach while also easily moving it beyond reach when desired is an element of preferred embodiments of the present invention. Inhibiting tumbling, rolling, or "end-over-end" movement and relying on sliding relative movement with an appropriate coefficient of friction helps to achieve this element.

One or more of the following systems may be employed to promote minimization of tumbling (which also promotes inhibition of device 100 from becoming air-borne in response to the impulse) over a surface upon which device 100 slides. The systems include: i) a relative density difference between said portions, ii) an anti-tumbling cross-section of the top portion, iii) a lowered center-of-gravity, iv) a reduced gap between the surface and the top portion, v) a low profile relative to lateral expanse, and vi) combinations thereof.

The relative density difference may be achieved by use of a low-density, light-weight foam top portion 105 (or bladder or frame as noted above) and a relative dense hard polymer/polycarbonate bottom portion 110. The exposed top portion 105 being low density helps to dampen impulsive forces and moderate response to exuberant children.

The anti-tumbling cross-section refers to use of rounded components and preferably less than fully hemispherical section for top portion 105 to reduce an ability to apply the impulse to a surface that can lift/launch device 100. That is, by exposing surfaces all less than perpendicular for receipt of the impulse, a component of the impulsive force tends to always be downward into the surface, thus maintaining device 100 in contact with the surface. A young child has a more difficult time of accidentally catching an edge or otherwise lifting or launching device 100 when kicked.

A lowered center-of-gravity is achieved not only by using the light-weight top portion and dense bottom portion, but also distribution and coupling to minimize a height of the center of gravity above the surface. In this way, impulses applied to device 100 by the child are more likely to be above the center of gravity, improving anti-tumbling characteristics.

A reduced gap between the surface and top portion 105 helps to resist tumbling. While device 100 includes top portion 105 coupled to bottom portion 110, bottom portion 110 preferably is inset into top portion 105 or top portion 105 includes a periphery component overlapping and covering at least part of bottom portion 110. The feature helps to inhibit tumbling by reducing an opportunity to catch an exposed edge of top portion 105. Additionally, this feature improves safety to people and property by cushioning the harder/denser bottom portion 110 when striking a person or other object.

A low profile relative to lateral expanse (e.g., top portion 105 not too high above the surface given a diameter of bottom portion 110) helps to maintain device 100 in sliding engagement over the surface. While there are several anti-tumbling parameters described, various parameters may be adjusted differently from embodiment to embodiment, implementation to implementation, and intended use to intended use such that in some devices one parameter may predominate or a set of parameters may counter-balance other parameters that may not optimally produce anti-tumbling characteristics alone without suitable adjustment of the counter-balancing parameters.

Figure 2:
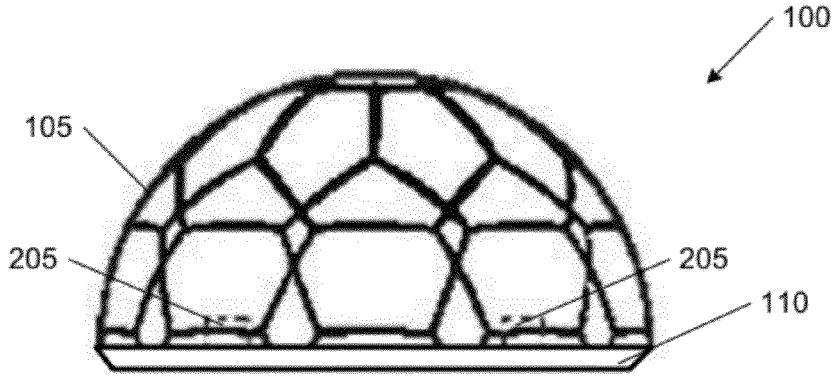
FIG. 2 is a side view of the device shown in FIG. 1.

FIG. 2 is a side view of device 100 shown in FIG. 1 illustrating an integration of top portion 105 and bottom portion 110. Top portion 105 is shown as an almost complete semi-hemisphere though other embodiments will include a lesser section. In addition, shown in FIG. 2 is a set of mating structures 205 that facilitate attachment of a rigid bottom portion 110 to a soft, pliant top portion 105. The disparate materials and construction of the portions to facilitate anti-tumbling advantageously including mating structures 205 to improve the integration and integrity of device 100 in response to repeated impulses.

Figure 3:
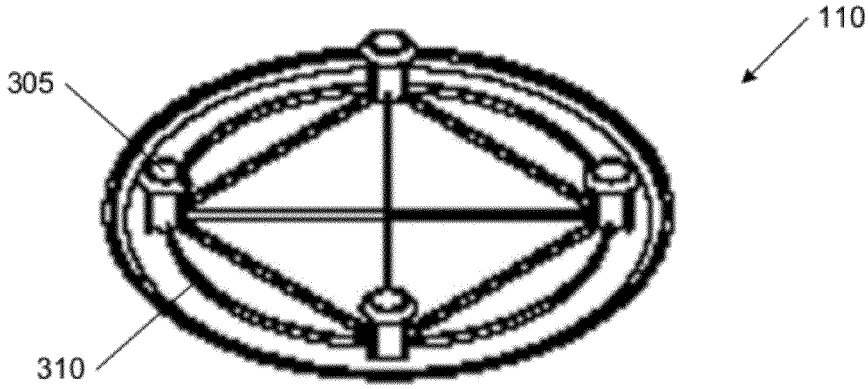
FIG. 3 is a perspective plan view of a sliding portion of the device shown in FIG. 1.

FIG. 3 is a perspective plan view of bottom portion 110 of device 100 shown in FIG. 1. FIG. 3 illustrates an example of the mating structures shown in FIG. 2, specifically a set of four posts 305 and sets of interconnecting splines 310. Not all embodiments would include both posts 305 and splines 310 or may include other mating structures.

Figure 4:
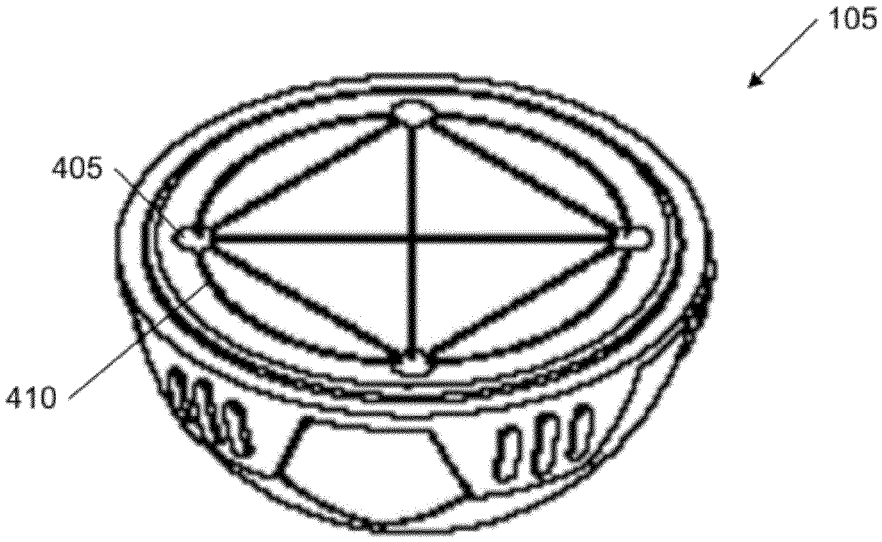
FIG. 4 is a perspective plan view of a bottom of the impulse-receiving portion of the device shown in FIG. 1.

FIG. 4 is a perspective plan view of an underside of top portion 105 of device 100 shown in FIG. 1. Top portion 105 includes complementary mating receptacles for mating structures shown in FIG. 2. Specifically, each mating post 305 matches a mating receptacle 405 and each mating spline 310 matches a complementary mating slot 410.

Figure 5:
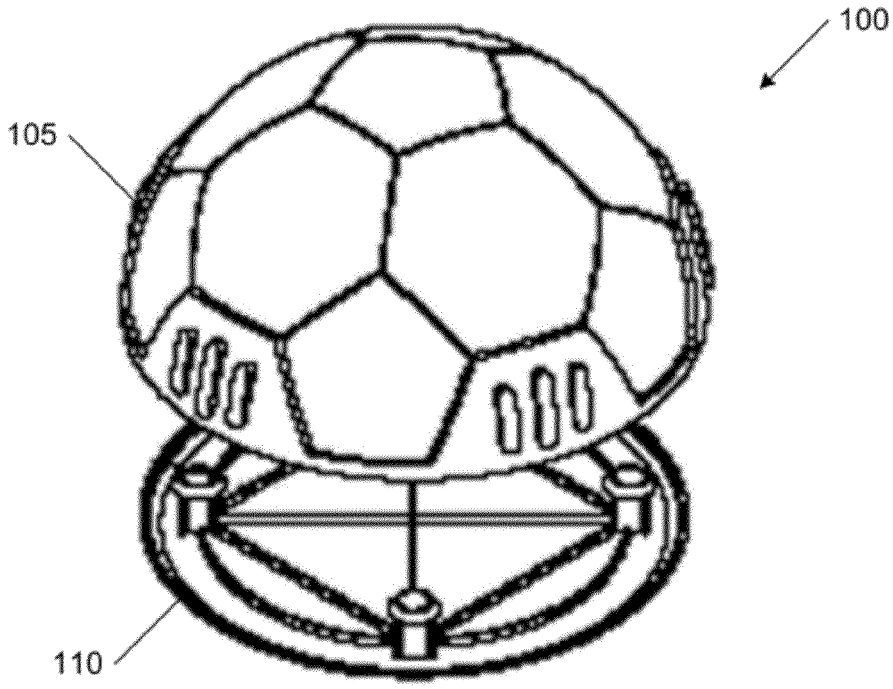
FIG. 5 is an exploded detail view of the device shown in FIG. 1.

FIG. 5 is an exploded detail view of device 100 shown in FIG. 1. Device 100 is formed by matching mating structures and applying epoxy or other adhering method or component or layer between the portions to integrate them together.

Figure 6:
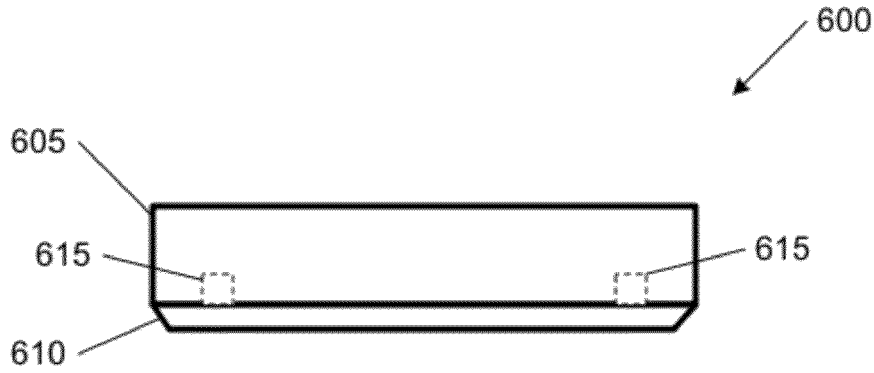
FIG. 6 is a side view of a second embodiment of an impulse-receiving device embodying the present invention.

FIG. 6 is a side view of a second embodiment of an impulse-receiving device 600 embodying the present invention. Device 600 is shaped similar to a puck having a diameter in a range of about two inches to about fifteen inches and more specifically in a range of about two to four inches for a more conventional puck size and about four inches to about fifteen inches for an "Easy Strike" puck size.

Device 600 includes a top portion 605 (similar in material and arrangement other than profile and patterning to top portion 105 shown in FIG. 1), a bottom portion 610 similar to bottom portion 110 except sized appropriately to match top portion 605, and mating structures 615 used to enhance integration of the disparate materials and resist separation during use.

Figure 7:
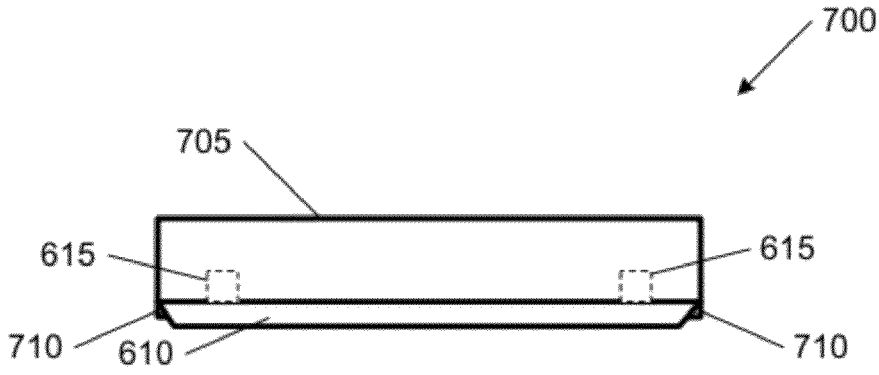
FIG. 7 is side view of an alternate embodiment of the present invention.

FIG. 7 is side view of an alternate embodiment for a device 700 embodying the present invention. While FIG. 7 depicts alternatives to device 600 shown in FIG. 6, the alternate construction is also applicable to device 100 when necessary or desirable. Device 700, similar to device 600, includes a top portion 705 that includes bottom portion 610 as an inset such that a peripheral portion 710 of top portion 705 surrounds and cushions a periphery of bottom portion 610. This peripheral portion 710 not only shields against direct contact of hard bottom plate 610 with people or objects, it also reduces a gap between a surface over which bottom portion contacts and slide and top portion 705, enhancing anti-tumbling configurations.

SOCCER/KICK EMBODIMENT (Soccer/Kick method)

Soft (foam, inflated etc.), lightweight "ball" component anywhere from half ball shape (in current manifestation) to full-round ball coupled above a substantially flat polymer component with low friction coefficient properties. Said components designed specifically to slide—with or without horizontal (spin like a globe) rotation—on any flat surface when motivated by kicking. Said components designed specifically not to roll, or tumble, vertically (end over end) when kicked. Said components designed specifically not to "roll away" (like a typical soccer ball) from the user unless motivated by kicking. Said components designed to provide weight distribution and shape to keep flat polymer component in contact with the flat surface, and make it unlikely that it will leave the ground. Said components designed to slide on a multitude of flat, slick surfaces (carpet, linoleum, wood, grass, concrete, blacktop, and the like) when motivated by kicking the ball component. Said components designed to have all soft exposed edges for improving safety for all age players. Alternative flat polymer component arrangements could include raised bumps, rings or a series of small, flat polymer components with a low friction coefficient, to achieve the desired slide effect. Said components may be as small in diameter as a miniature "ball-like puck" (perhaps 3-4" d) to a full sized soccer ball to an oversized playground-style ball. Alternate ball design comprising a skeleton structure attached to polymer component for same use as above.

ALTERNATIVE EMBODIMENT (Hockey/Hit method)

Soft (foam, inflated etc.), lightweight "puck" component coupled above a substantially flat polymer component with low friction coefficient properties. Said components designed specifically to slide—with or without horizontal (spin like a globe) rotation—on any flat surface when motivated by hitting with hockey stick or the like. Said components designed specifically not to roll, or tumble, vertically (end over end) when hit with hockey stick or the like. Said components designed specifically not to "roll away" (like a typical hockey puck on ice) from the user unless motivated by hitting with hockey stick or the like. Said components designed to provide weight distribution and shape to keep flat polymer component in contact with the flat surface, and make it unlikely that it will leave the ground. Said components designed to slide on a multitude of flat, slick surfaces (carpet, linoleum, wood, grass, concrete, blacktop, and the like) when motivated by hitting the puck component. Said components designed to have all soft exposed edges for improving safety for all age players. Alternative flat polymer component arrangements could include raised bumps, rings or a series of small, flat polymer components with a low friction coefficient, to achieve the desired slide effect. Said components may be as small in diameter as a miniature "puck" (perhaps 2-4" d) to an oversized puck (4"-15") for easier hitting and younger aged users.

In the preceding discussion, preferred embodiments typically describe a two-part construction for the sliding impulse devices; an upper portion for receiving an impulse/interaction from a person. The impulse/interaction is provided directly by contacting/striking/kicking/hitting/punching/throwing/tossing the device using a portion of the person's body or indirectly by using a tool operated by the person (e.g., an implement simulating participation an athletic event, preferably the athletic event consistent with the simulation suggested by the sliding impulse device). That is, when the sliding impulse device simulates a baseball, the implement may simulate or be suggestive of a baseball bat.

The description herein further includes single piece construction for the sliding impulse device. That is, in a single piece, the resulting device includes a soft, collision-tempering, elastic outer body that includes a hard, low coefficient of friction, slide-enhancing bottom surface. The molding and processing of the material results in the device acquiring these properties during manufacture without requiring assembly of a top portion and a bottom portion. The devices described herein may be constructed using one-piece or two-piece designs.

The implementations described below further highlight additional features of the present invention, including use of contextualizers that simulate some element of a relevant event (e.g., an athletic event) consistent with the activity suggested or simulated by the impulse device. Preferably the contextualizers are interactive with the impulse device, but need not be interactive.

Interactivity may be enhanced by embedding electronics in one or more of the components, such as the impulse device, any applicable implement, and/or any applicable contextualizer. The electronics provide effects, such as background sounds and visual indications, feedback of impulse/interaction and/or progress in the event, or other audio or visual cues or presentations.

Further details are set forth herein, including descriptions of FIG. 8 through FIG. 17, however those implementations and embodiments are simply representative and do not limit the scope of the present invention as other implementations and embodiments are contemplated by the inventors.

Figure 8:
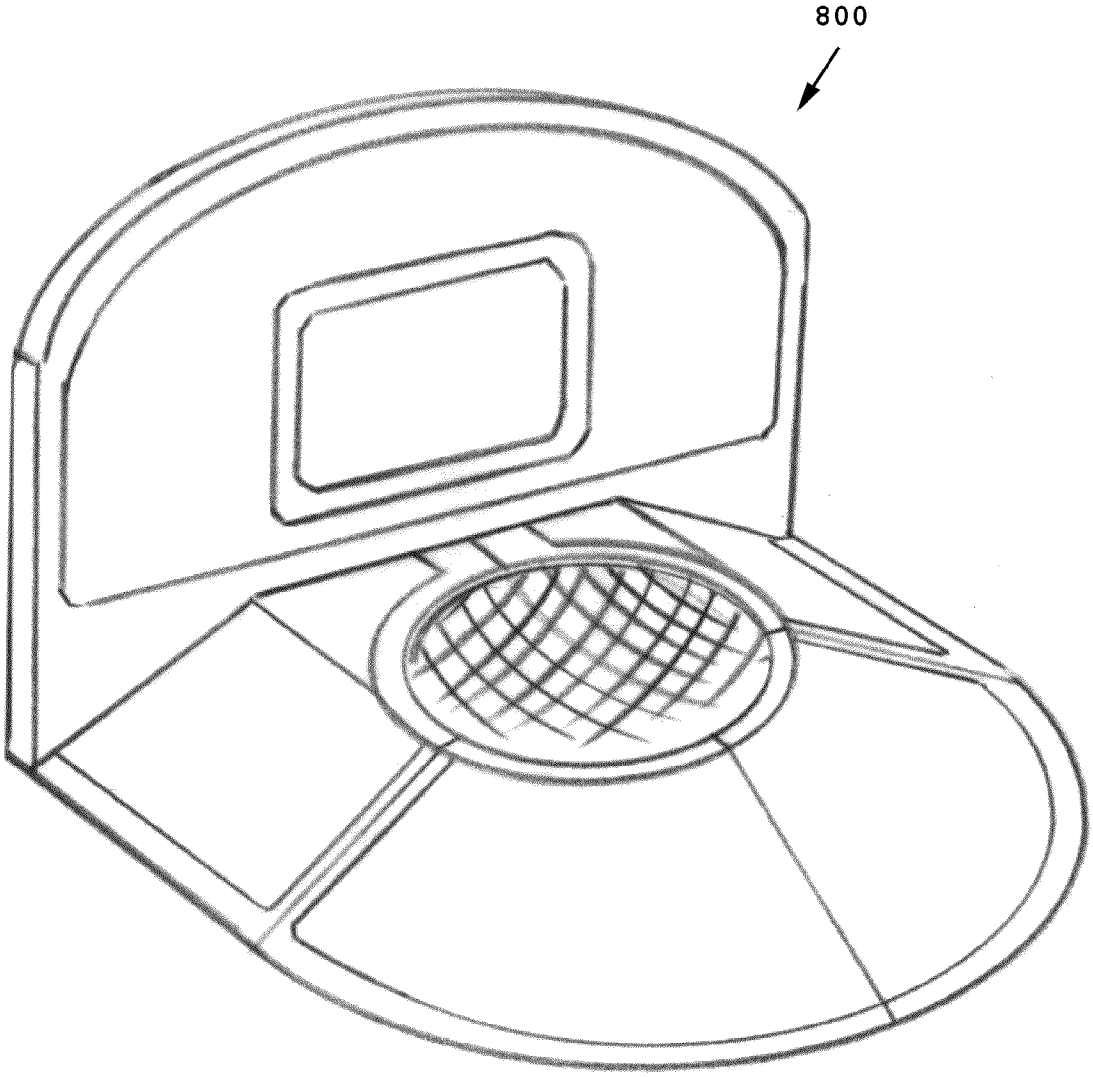
FIG. 8 is a perspective view of a contextualizer configured as a basketball simulating structure.

FIG. 8 is a perspective view of a contextualizer 800 configured as a basketball simulating structure. The basketball simulating structure includes a basketball goal (e.g., a hoop). Optional electronics included in contextualizer 800 provides effects, audio and/or visual, that may count successful goals (visually or audibly for example), provide background cheers, simulated sights/sounds of a basketball striking a backboard/ring or the like.

Figure 9:
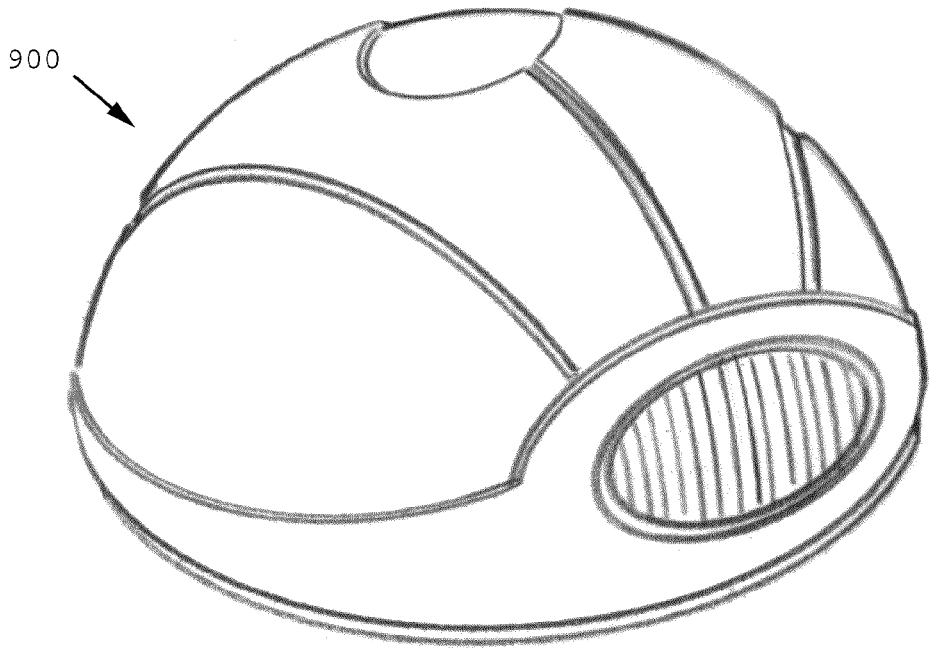
FIG. 9 is a perspective view of a basketball simulating sliding impulse device.

FIG. 9 is a perspective view of a basketball simulating sliding impulse device 900. Device 900 is useable with contextualizer 800 shown in FIG. 8 to enhance a simulation/suggestion that the person is participating in a basketball game or the like. Device 900 may also include embedded electronics to provide audio/visual cues, signals, feedback or other effects. In some cases, interactivity may be enhanced by providing electronics and sensors for proximity/contact detection to respond when the person applies the impulse to the device and/or when the device interacts with a contextualizer.

Figure 10:
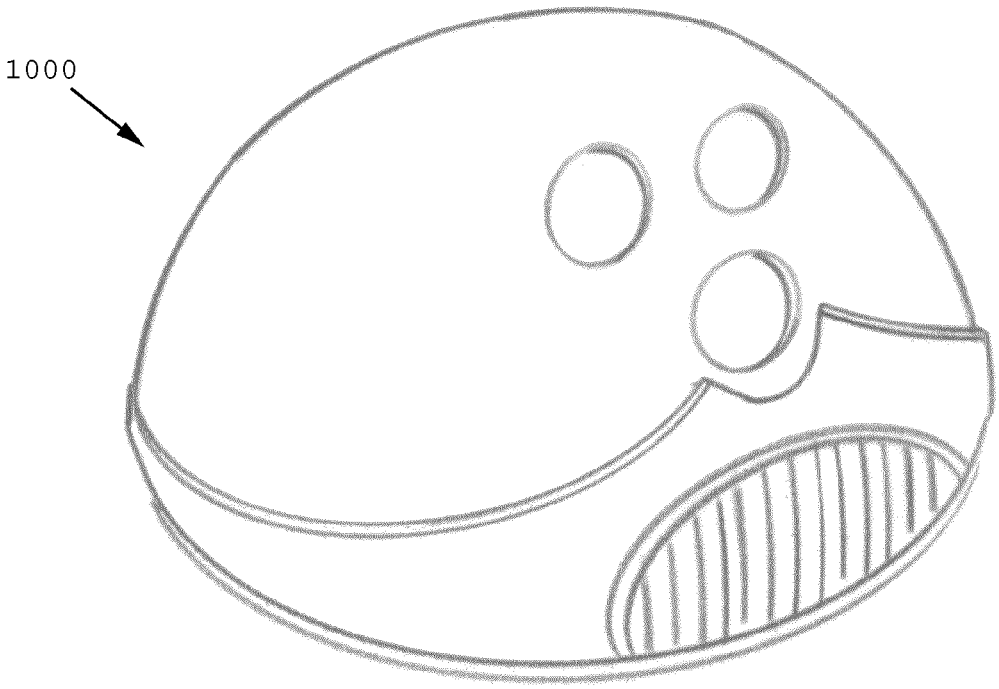
FIG. 10 is a perspective view of a bowling ball simulating sliding impulse device.

FIG. 10 is a perspective view of a bowling ball simulating sliding impulse device 1000. It may be used with a bowling alley contextualizer (not shown) that may include an "alley" and a plurality of "pins" for use with device 1000. Other features, functions, and characteristics of device 1000 are similar to those of device 900 described with respect to FIG. 9, except for the type of event simulated/suggested of course.

Figure 11:
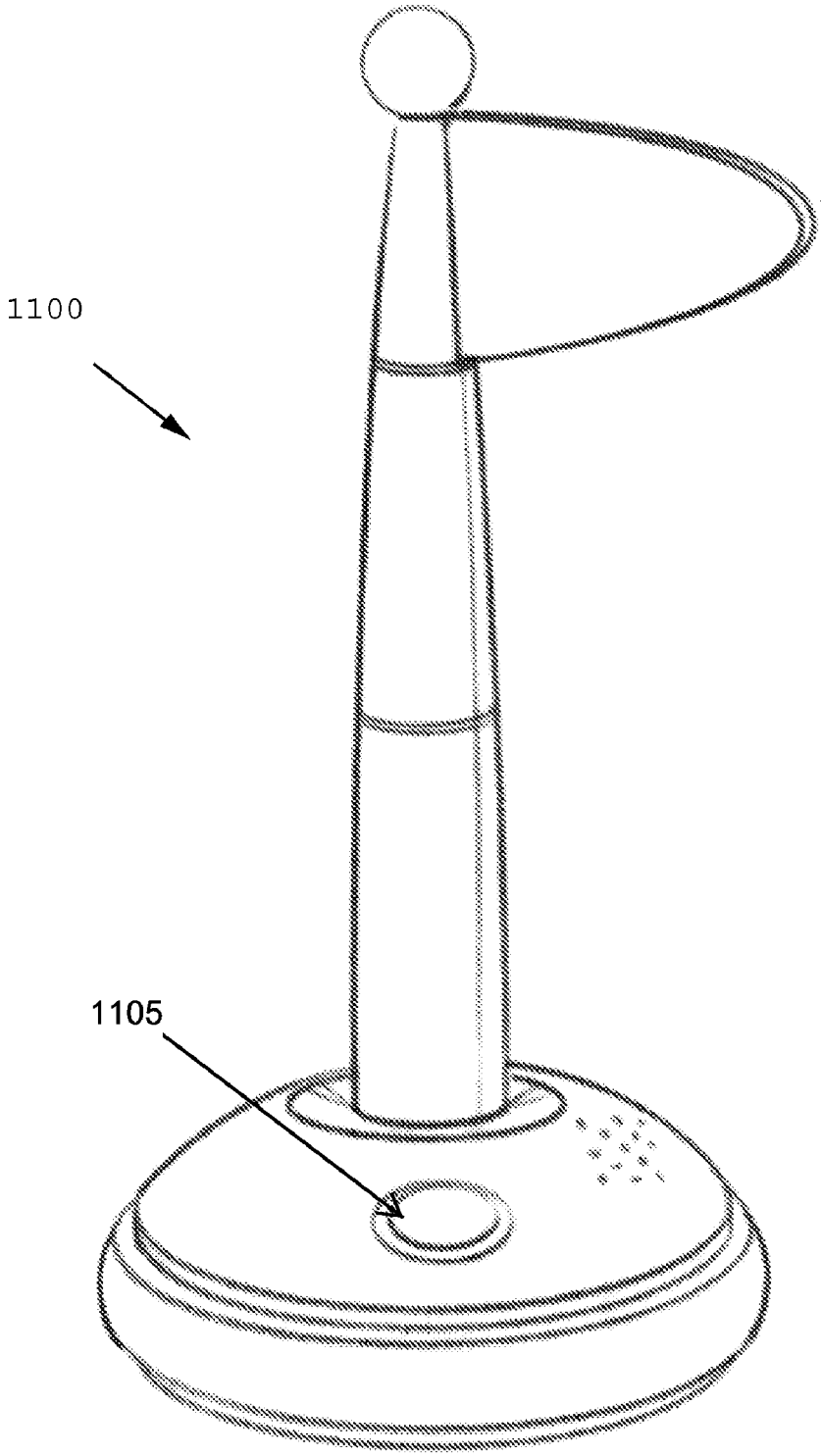
FIG. 11 is a perspective view of a contextualizer configured as a golf hole flag simulating structure.

FIG. 11 is a perspective view of a contextualizer configured as a golf hole flag simulating structure 1100. Structure 1100 provides the person with a simulation/suggestion of a golf context for their interactions and playtime. Structure 1100 is preferably responsive to contact or proximity of an impulse device to provide appropriate effects. Magnets, sensors, contactors, and the like may be used to provide interactivity. This is preferably provided by an electronics assembly 1105 included inside structure 1100, assembly 1105 including a battery (or other energy source such as a piezoelectric device), a microprocessor/microcontroller/microcomputer or the like, a memory for storing data and computer-executable instructions, and an interface to receive and/or send control signals.

Figure 13:
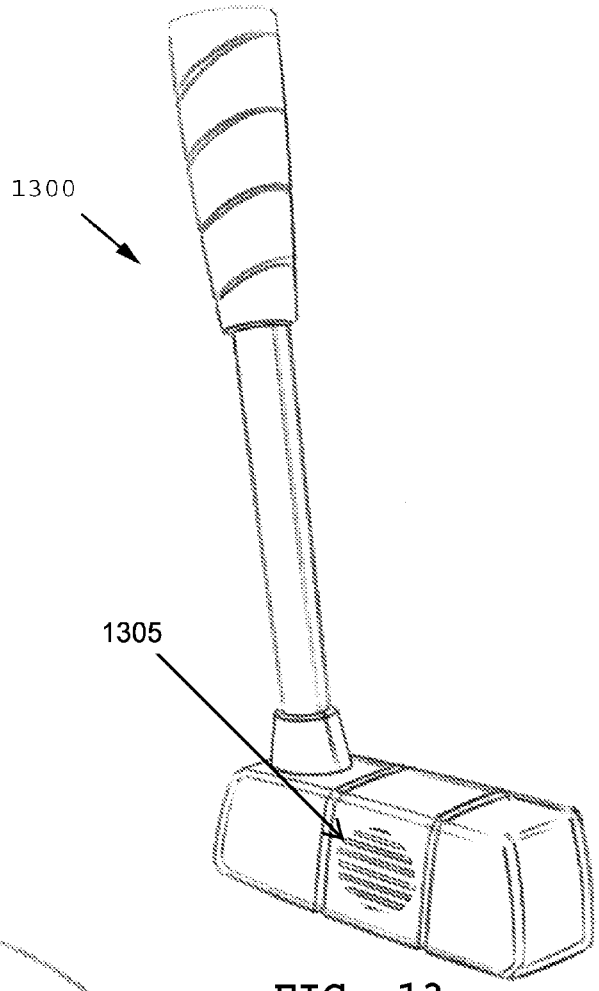
FIG. 13 is a perspective view of a club/mallet simulating implement for striking a sliding impulse device.
Figure 12:
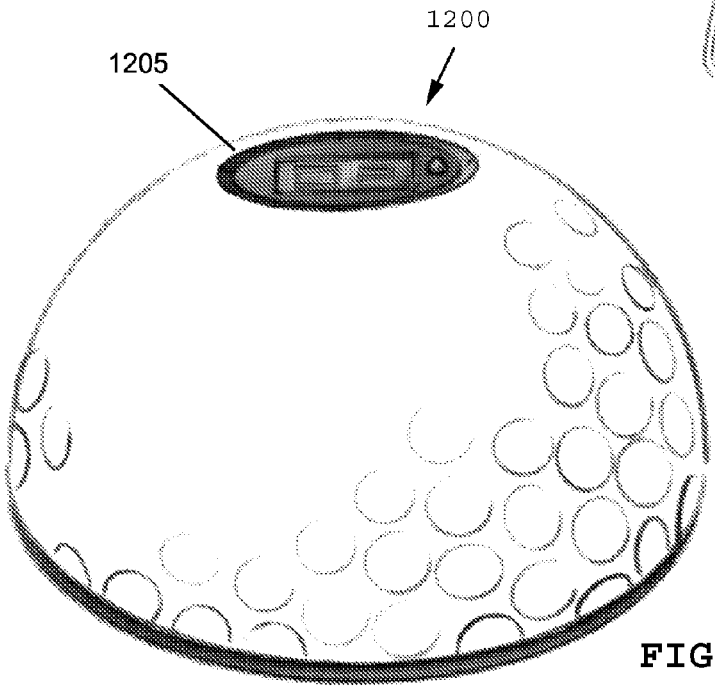
FIG. 12 is a perspective view of a golf ball simulating sliding impulse device.

FIG. 12 is a perspective view of a golf ball simulating sliding impulse device 1200 and FIG. 13 is a perspective view of a club/mallet simulating implement 1300 for striking a sliding impulse device. For example, device 1200 and implement 1300 are useable with structure 1100 shown in FIG. 11. As shown, device 1200 includes an electronics assembly 1205 for providing effects, in this case for recording a number of applied impulses on a display of electronics assembly 1205 since a reset has been used. In this way, a number of "strokes" may be recorded. Similarly, implement 1300 is shown with a transducer 1305 (e.g., a speaker) to provide audible feedback, such as when device 1200 is struck. The audio feedback of a stroke may also be incorporated into device 1200 which could have the advantage of fewer electronics assemblies and fewer batteries.

Figure 14:
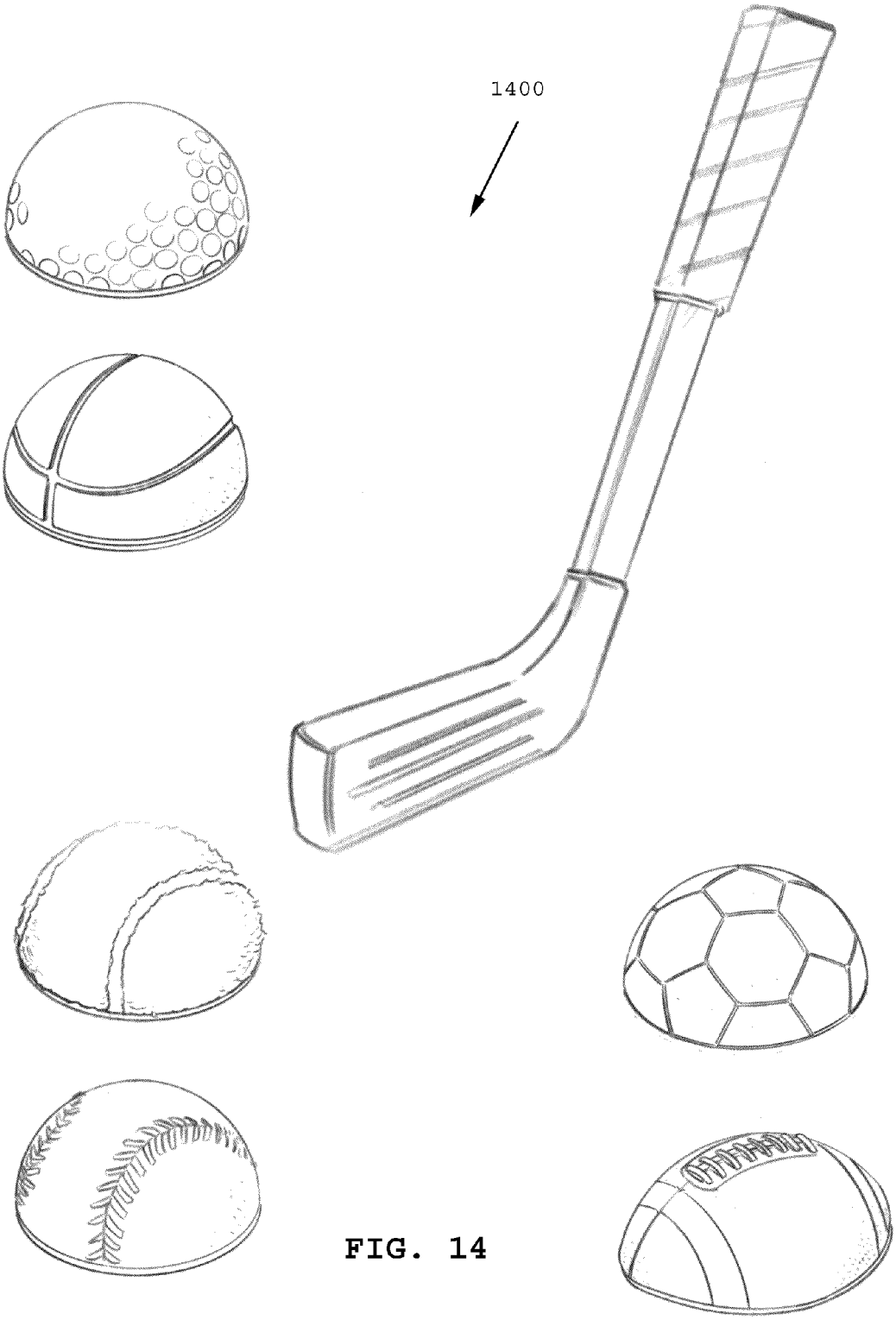
FIG. 14 is a perspective view of an assortment of athletic ball simulating sliding impulse device and an implement for applying an impulse to the devices.

FIG. 14 is a perspective view of an assortment 1400 of athletic ball simulating sliding impulse device and an implement for applying an impulse to the devices. One common element of the devices is that they preferably do not include an exterior profile that represents more than one-half of the athletic ball (for round balls, this means that the devices are not greater than a hemispherical section of the simulated athletic ball).

Figure 15:
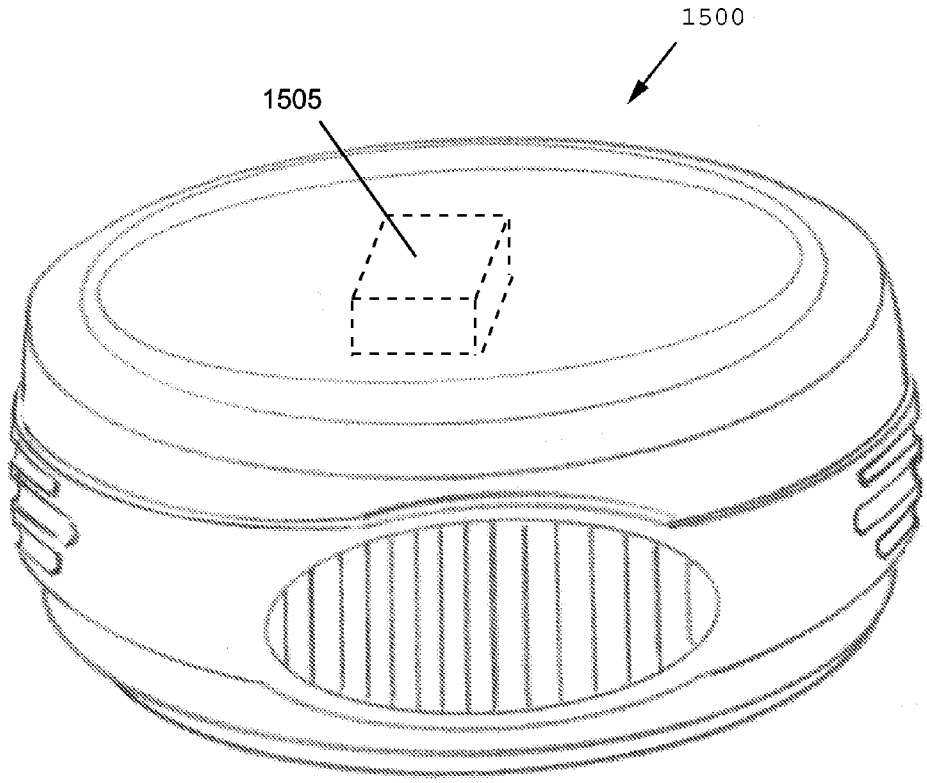
FIG. 15 is a perspective view of an alternative implementation for a puck-type sliding impulse device.

FIG. 15 is a perspective view of an alternative implementation for a puck-type sliding impulse device 1500. Device 1500 includes an electronics assembly 1505 for providing appropriate effects.

Figure 16:
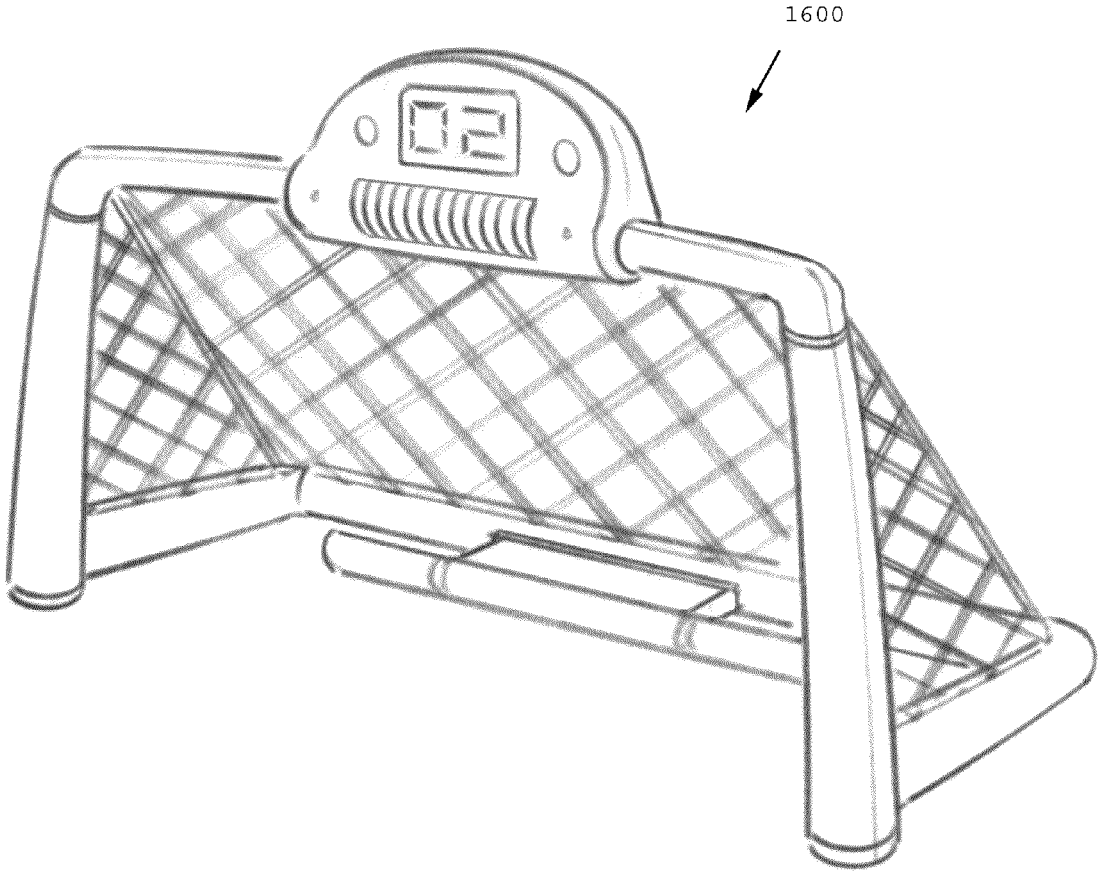
FIG. 16 is a perspective view of a contextualizer configured as a goal net simulating structure.

FIG. 16 is a perspective view of a contextualizer 1600 configured as a goal net simulating structure. Contextualizer 1600 may be used to simulate/suggest soccer, hockey, lacrosse, cricket, croquet, or other similar goal. Contextualizer 1600 also preferably includes an electronics assembly to provide effects, such as a number of goals, and background sounds (e.g., cheering and the like).

Figure 17:
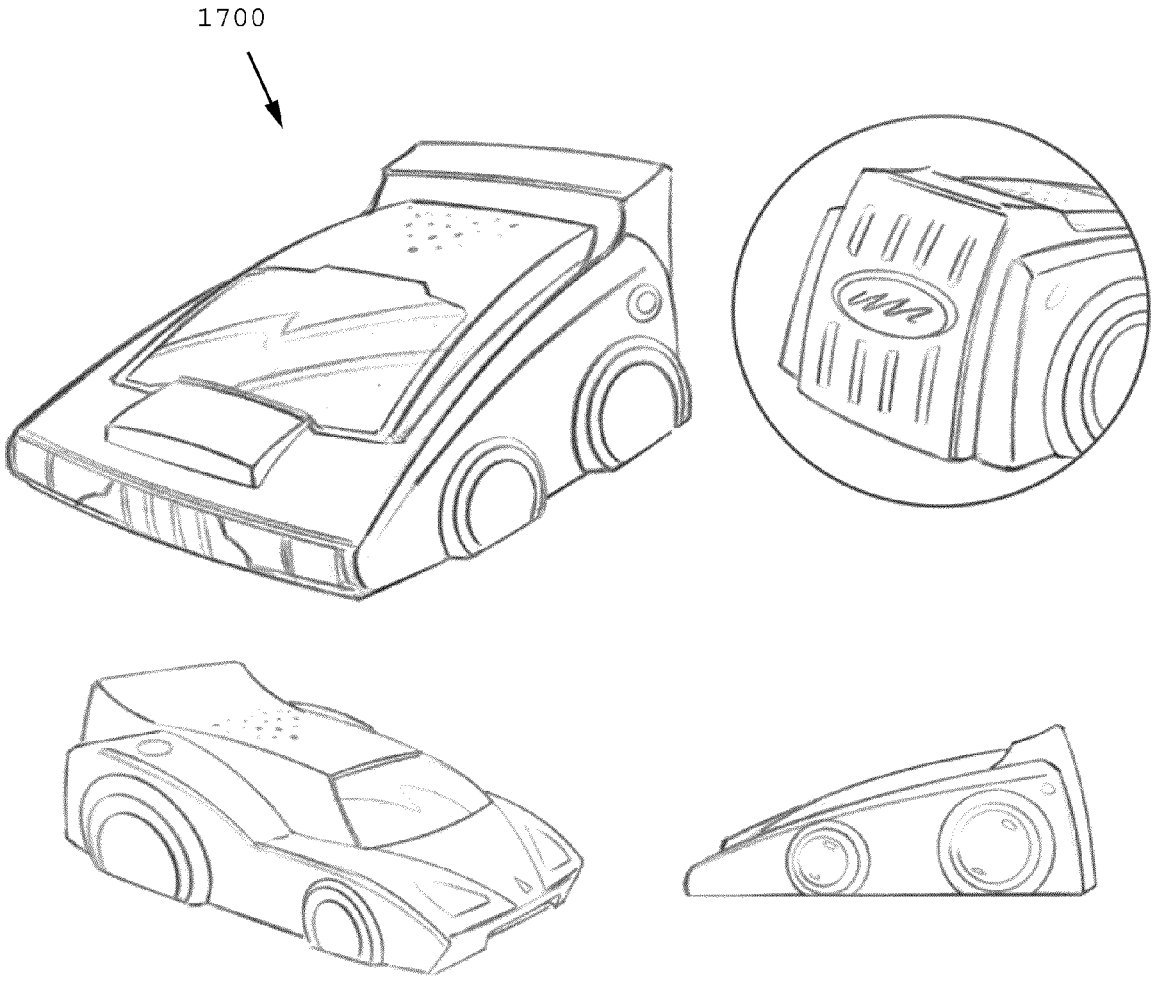
FIG. 17 is a perspective view of an assortment of non-athletic ball simulating impulse/interaction receiving portions, specifically simulating a vehicle.

FIG. 17 is a perspective view of an assortment of non-athletic ball simulating impulse/interaction receiving portions, specifically simulating a vehicle 1700. In this configuration, the upper shell (for two piece construction) or the upper portion (for one-piece construction) is shaped like a vehicle. The lower portion is structured similar to other devices described herein. Some embodiments include an electronics assembly that provides effects. These effects may include audio/visual elements, such as "starting," "revving," and/or "colliding" and the like.

In the description herein, numerous specific details are provided, such as examples of components and/or methods, to provide a thorough understanding of embodiments of the present invention. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Reference throughout this specification to "one embodiment", "an embodiment", or "a specific embodiment" means that a particular feature, structure, or characteristic described in connection with the embodiment is included in at least one embodiment of the present invention and not necessarily in all embodiments. Thus, respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

Additionally, any signal arrows in the drawings/Figures should be considered only as exemplary, and not limiting, unless otherwise specifically noted. Furthermore, the term "or" as used herein is generally intended to mean "and/or" unless otherwise indicated. Combinations of components or steps will also be considered as being noted, where terminology is foreseen as rendering the ability to separate or combine is unclear.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims. Thus, the scope of the invention is to be determined solely by the appended claims.

What is claimed as new and desired to be protected by Letters Patent of the United States is:

1. An apparatus motivated by an interaction to slide over a support surface, comprising:

an upper interaction receiving portion for receiving the interaction when applied by a person interacting with said interaction portion with a body appendage of said person, wherein said interaction receiving portion has a diameter in a range of about two inches to about fifteen inches, wherein said interaction-receiving portion includes an exterior component configured to resemble a portion of an athletic ball wherein said athletic ball includes an outer surface generally shaped as a hemisphere and said portion consists of an outer surface generally shaped as a section of said hemisphere; and a lower sliding portion for sliding contact with the support surface responsive to the interaction, said sliding portion including a generally planar component having a diameter no greater than the diameter of said interaction-receiving portion, wherein said interaction-receiving portion at least partially overlaps a periphery of a circumference of said sliding portion to cushion said sliding portion when striking an object;

wherein a center of gravity of said interaction-receiving portion and said sliding portion is shifted towards the surface by use of a low- density material for said interaction-receiving portion and a high- density material for said sliding portion.

2. The apparatus of claim 1 wherein said sliding portion includes an exposed lateral edge extending from the support surface to said interaction-receiving portion wherein said exposed lateral edge forms an angle with respect to the support surface that is angled inwardly.

3. An apparatus motivated by an interaction to slide over a support surface, comprising:

an upper interaction receiving portion for receiving the interaction when applied by a person interacting with said interaction portion with a body appendage of said person, wherein said interaction receiving portion has a diameter in a range of about two inches to about fifteen inches, wherein said interaction-receiving portion includes an exterior component configured to resemble a portion of an athletic ball wherein said athletic ball includes an outer surface generally shaped as a hemisphere and said portion consists of an outer surface generally shaped as a section of said hemisphere;

a lower sliding portion for sliding contact with the support surface responsive to the interaction, said sliding portion including a generally planar component having a diameter no greater than the diameter of said interaction-receiving portion, wherein said interaction-receiving portion at least partially overlaps a periphery of a circumference of said sliding portion to cushion said sliding portion when striking an object; and means for matingly attaching said upper interaction-receiving portion to said lower sliding portion;

wherein a center of gravity of said interaction-receiving portion and said sliding portion is shifted towards the surface by use of a low- density material for said interaction-receiving portion and a high- density material for said sliding portion.

4. The apparatus of claim 1 further comprising an electronics module incorporated into an element of the apparatus for providing effects to said person.

5. The apparatus of claim 1 wherein a center of gravity of said interaction-receiving portion coupled to said sliding portion is shifted towards the support surface by use of a low-density material for said interaction-receiving portion and a high-density material for said sliding portion.

6. An apparatus motivated by a physical interaction between a person and the apparatus to slide over a support surface, comprising:

an upper interaction-receiving portion for receiving the physical interaction from the person, wherein said interaction-receiving portion has an interaction-receiving portion width in a range of at least about two inches to no more than about fifteen inches and, wherein said interaction-receiving portion includes an exterior component configured to resemble a representative portion of an athletic device used in athletic events, said athletic device including one of a ball or a puck, said athletic ball symmetric about a plane dividing said athletic device into an upper hemisphere portion and a lower hemisphere portion and wherein said representative portion consists of a section of said upper hemisphere portion of said athletic device; and a lower sliding portion for sliding contact with the support surface responsive to the physical interaction, said sliding portion including a generally planar component having a width no greater than the width of said impulse-receiving portion; and wherein said interaction-receiving portion at least partially overlaps a periphery of a perimeter of said sliding portion to cushion said sliding portion when interacting with an object; and wherein a center of gravity of said interaction-receiving portion coupled to said sliding portion is shifted towards the support surface by use of a low-density material for said impulse-receiving portion and a high-density material for said sliding portion.

7. The apparatus of claim 6 wherein the physical interaction includes application of an impulse by the person by contacting the interaction-receiving portion with a portion of a body of the person.

8. The apparatus of claim 6 wherein the physical interaction includes application of an impulse by the person by contacting the interaction-receiving portion with a portion of an implement held in at least one hand of said person.

9. The apparatus of claim 8 wherein said implement includes an electronics module providing effects to said person.

10. The apparatus of claim 6 further comprising an electronics module incorporated into an element of the apparatus for providing effects to said person.

11. The apparatus of claim 6 further comprising a contextualizer subassembly providing one or more interactive goals for the person wherein said one or more interactive goals include one or more interactions between the interaction-receiving portion and said contextualizer subassembly.

12. The apparatus of claim 11 wherein said contextualizer subassembly includes one or more elements selected from the group consisting of a basketball goal, a hockey goal, a soccer goal, a strike zone, a golf hole, a bowling alley including a set of simulated bowling pins, a tennis court, an end zone, a volley ball court, a horseshoe stake, a croquet wicket, a cricket wicket, an athletic goal, and combinations thereof.

13. The apparatus of claim 8 wherein said implement includes one or more elements selected from the group consisting of a golf club, a bat, a lacrosse pole, a hockey stick, a polo mallet, a croquet mallet, other athletic implement, and combinations thereof.

14. A method for motivating an object by an interaction to slide over a support surface, the method comprising the steps of:

(a) receiving the interaction at an upper interaction-receiving portion applied by a person interacting with said interaction portion with a body appendage of said person, wherein said interaction receiving portion has a diameter in a range of about two inches to about fifteen inches, wherein said interaction-receiving portion includes an exterior component configured to resemble a representative portion of an athletic device, said device including one of a ball or a puck, said athletic device symmetric about a plane dividing said athletic device into an upper hemisphere portion and a lower hemisphere portion and wherein said representative portion consists of a section of said upper hemisphere portion of said athletic device and wherein said device further includes an electronics module for providing effects to said person; and (b) contacting slidingly a lower sliding portion with the support surface responsive to the interaction producing a sliding, non-tumbling motion of the object over the support surface, said sliding portion including a generally planar component having a diameter no greater than the diameter of said interaction-receiving portion, wherein said interaction- receiving portion at least partially overlaps a periphery of a circumference of said sliding portion to cushion said sliding portion when striking an object.

15. An apparatus motivated by an interaction to slide over a support surface, comprising:

an upper interaction receiving portion for receiving the interaction when applied by a person interacting with said interaction portion with a body appendage of said person, wherein said interaction receiving portion has a diameter in a range of about two inches to about fifteen inches, wherein said interaction-receiving portion includes an exterior component configured to resemble a portion of an athletic ball wherein said athletic ball includes an outer surface generally shaped as a hemisphere and said portion consists of an outer surface generally shaped as a section of said hemisphere; and a lower sliding portion for sliding contact with the support surface responsive to the interaction, said sliding portion including a generally planar component having a diameter no greater than the diameter of said interaction-receiving portion, wherein said interaction-receiving portion at least partially overlaps a periphery of a circumference of said sliding portion to cushion said sliding portion when striking an object; and means for matingly attaching said upper interaction-receiving portion to said lower sliding portion;

wherein a center of gravity of said interaction-receiving portion and said sliding portion is shifted towards the surface by use of a low- density material for said interaction-receiving portion and a high- density material for said sliding portion.

16. A toy system, comprising:

a sliding non-tumbling impulse device including an upper interaction receiving portion mated to a lower sliding portion, wherein said interaction-receiving portion includes an exterior component configured to resemble a representative portion of an athletic device used in an athletic venue, said device including one of a ball or a puck, said athletic device symmetric about a plane dividing said athletic device into an upper hemisphere portion and a lower hemisphere portion and wherein said representative portion consists of a section of said upper hemisphere portion of said athletic device;

a contextualizer having a theme consistent with effecting a score using said sliding non-tumbling impulse device in said athletic venue; and an electronics module coupled to one of said sliding non-tumbling impulse device and said contextualizer to measure said score responsive to a proximity of said sliding non-tumbling impulse device to said contextualizer.

17. The toy system of claim 16 wherein said athletic device is a golf ball, and wherein said contextualizer includes a moveable base supporting an upwardly extending flag.

18. The toy system of claim 16 further comprising a sports implement having a theme consistent with effecting an interaction with said sliding non-tumbling impulse device in said athletic venue.

19. The toy system of claim 18 wherein said athletic device is a golf ball, and wherein said sports implement includes a golf club.

* * * * *